US008585050B2

(12) United States Patent
Syracuse et al.

(10) Patent No.: US 8,585,050 B2
(45) Date of Patent: Nov. 19, 2013

(54) COMBINED ULTRASONIC-BASED MULTIFEED DETECTION SYSTEM AND SOUND-BASED DAMAGE DETECTION SYSTEM

(75) Inventors: Anthony A. Syracuse, Fairport, NY (US); Randall R. Maysick, Churchville, NY (US); Thomas Gregory Middleton, Scottsville, NY (US); Daniel P. Phinney, Rochester, NY (US); Swapnil Sakharshete, Rochester, NY (US); David M. Schaertel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/312,501

(22) Filed: Dec. 6, 2011

(65) Prior Publication Data

US 2013/0140760 A1 Jun. 6, 2013

(51) Int. Cl.
*B65H 7/02* (2006.01)

(52) U.S. Cl.
USPC ..... 271/258.01; 271/263; 271/262

(58) Field of Classification Search
USPC ..... 271/258.01, 262, 263, 258.03, 258.04
See application file for complete search history.

(56) References Cited

U.S. PATENT DOCUMENTS

| | | | | |
|---|---|---|---|---|
| 3,603,680 | A * | 9/1971 | Barton | 399/21 |
| 3,663,956 | A | 5/1972 | Purdy et al. | |
| 3,754,207 | A | 8/1973 | Delignieres | |
| 3,763,483 | A | 10/1973 | Urmenyl | |
| 3,813,165 | A | 5/1974 | Hines et al. | |
| 3,932,755 | A | 1/1976 | Sagawa | |
| 3,953,794 | A | 4/1976 | Moore | |
| 4,066,969 | A * | 1/1978 | Pearce et al. | 367/125 |
| 4,286,149 | A | 8/1981 | Ben-Nathan et al. | |
| 4,368,438 | A | 1/1983 | Stienstra | |
| 4,370,574 | A | 1/1983 | Nielsen | |
| 4,400,664 | A | 8/1983 | Moore | |
| 4,408,165 | A | 10/1983 | Braun | |
| 4,425,543 | A | 1/1984 | Adams et al. | |
| 4,600,994 | A | 7/1986 | Hayashi | |
| 4,607,218 | A | 8/1986 | Stosel | |
| 4,691,100 | A | 9/1987 | Kizu et al. | |
| 4,693,010 | A | 9/1987 | Sills | |
| 4,724,481 | A | 2/1988 | Nishioka | |
| 4,775,890 | A | 10/1988 | Balaban et al. | |
| 4,807,263 | A | 2/1989 | Ohno et al. | |
| 4,845,761 | A | 7/1989 | Cate et al. | |
| 4,963,817 | A | 10/1990 | Kohiyama et al. | |
| 4,975,971 | A | 12/1990 | Ohnishi | |
| 4,983,854 | A | 1/1991 | Mizuno et al. | |

(Continued)

FOREIGN PATENT DOCUMENTS

| | | |
|---|---|---|
| DE | 36 20 042 | 1/1987 |
| DE | 197 01 644 | 7/1998 |

(Continued)

*Primary Examiner* — Kaitlin Joerger
*Assistant Examiner* — Ernesto Suarez
(74) *Attorney, Agent, or Firm* — Eugene I. Shkurko; Amit Singhai

(57) ABSTRACT

A document handling apparatus having a document transport path for moving a document therethrough. A detector proximate the transport detects a multifeed indication in the transport path or a misfeed indication in the transport path. A processing system processes the indications and issues a termination signal if a multifeed or a misfeed, or both, is determined.

17 Claims, 6 Drawing Sheets

(56) References Cited

U.S. PATENT DOCUMENTS

| | | | | |
|---|---|---|---|---|
| 5,005,192 | A | 4/1991 | Duss | |
| 5,023,846 | A | 6/1991 | Busch-Sorensen | |
| 5,067,704 | A | 11/1991 | Tsuihiji et al. | |
| 5,151,638 | A | 9/1992 | Beckerman | |
| 5,174,562 | A | 12/1992 | Mizunaga et al. | |
| 5,266,851 | A | 11/1993 | Nukui | |
| 5,432,826 | A | 7/1995 | Rieder | |
| 5,438,254 | A | 8/1995 | Ho et al. | |
| 5,481,198 | A | 1/1996 | Patel | |
| 5,506,874 | A | 4/1996 | Izzard et al. | |
| 5,560,598 | A | 10/1996 | Goldkuhle | |
| 5,568,071 | A | 10/1996 | Hoshino et al. | |
| 5,583,458 | A | 12/1996 | Bazes | |
| 5,604,768 | A | 2/1997 | Fulton | |
| 5,619,148 | A | 4/1997 | Guo | |
| 5,818,265 | A | 10/1998 | Meller et al. | |
| 5,823,529 | A | 10/1998 | Mandel et al. | |
| 5,903,605 | A | 5/1999 | Crittenden | |
| 5,949,260 | A | 9/1999 | Toda | |
| 5,971,388 | A | 10/1999 | Hattori et al. | |
| 6,069,681 | A | 5/2000 | Nakagawa et al. | |
| 6,145,376 | A | 11/2000 | Elgee | |
| 6,212,130 | B1 | 4/2001 | Brazeal et al. | |
| 6,397,671 | B1 | 6/2002 | Nishiio et al. | |
| 6,407,599 | B1 | 6/2002 | Phinney et al. | |
| 6,511,064 | B1 * | 1/2003 | Phinney et al. | 271/262 |
| 6,520,498 | B2 * | 2/2003 | Phinney | 271/263 |
| 6,761,352 | B2 | 7/2004 | Scicluna et al. | |
| 6,868,135 | B1 | 3/2005 | Phinney et al. | |
| 6,913,259 | B2 | 7/2005 | Phinney et al. | |
| 7,025,348 | B2 | 4/2006 | Phinney et al. | |
| 7,810,716 | B2 * | 10/2010 | Ma et al. | 235/379 |
| 2001/0035603 | A1 | 11/2001 | Graves et al. | |
| 2003/0094748 | A1 | 5/2003 | Chujo et al. | |
| 2006/0000889 | A1 | 1/2006 | Ma | |
| 2006/0145412 | A1 * | 7/2006 | Tagawa et al. | 271/258.01 |
| 2007/0070456 | A1 | 3/2007 | Nishimura | |
| 2007/0177887 | A1 | 8/2007 | Haas et al. | |
| 2013/0140757 | A1 * | 6/2013 | Phinney et al. | 271/10.01 |
| 2013/0140766 | A1 * | 6/2013 | Syracuse et al. | 271/262 |

FOREIGN PATENT DOCUMENTS

| | | |
|---|---|---|
| DE | 198 52 719 | 6/1999 |
| EP | 1 148 012 | 10/2001 |
| EP | 1 612 168 | 1/2006 |
| JP | 58-078935 | 5/1983 |
| JP | 07-302019 | 11/1995 |
| JP | 09-110239 | 4/1997 |
| JP | 10-019662 | 1/1998 |
| JP | 2001-302021 | 10/2001 |
| JP | 2004-205215 | 7/2004 |

* cited by examiner

COMBINED ULTRASONIC-BASED MULTIFEED DETECTION SYSTEM AND SOUND-BASED DAMAGE DETECTION SYSTEM

CROSS REFERENCE TO RELATED APPLICATIONS

The following U.S. patents and patent application are assigned to the same assignee hereof, Eastman Kodak Company of Rochester, N.Y., and contain subject matter related, in certain respect, to the subject matter of the present patent application. These patents and patent application are incorporated herein by reference in their entirety.

U.S. Pat. No. 6,511,064 Method And Apparatus For Multiple Document Detection Using Ultrasonic Phase Shift Amplitude;

U.S. Pat. No. 7,025,348 Method And Apparatus For Detection Of Multiple Documents In A Document Scanner Using Multiple Ultrasonic Sensors;

U.S. Pat. No. 6,407,599 Method And Apparatus For Determining A Digital Phase Shift In A Signal;

U.S. Pat. No. 6,868,135 Method And Apparatus For Correcting. For A Phase Shift Between A Transmitter And A Receiver;

U.S. Pat. No. 6,520,498 Method And Apparatus For Detection Of Wrinkled Documents In A Sheet Feeding Device;

U.S. Pat. No. 6,913,259 Apparatus For Detection Of Multiple Documents In A Document Transport;

U.S. Ser. No. 13/273,263, filed: Oct. 14, 2011, entitled Jam Sensing At Document Feeding Station;

U.S. patent application Ser. No. 13/312,340 filed concurrently herewith, entitled "Combined Ultrasonic-Based Multifeed Detection Method And Sound-Based Damage Detection Method", and U.S. patent application Ser. No. 13/312,601 filed concurrently herewith, entitled "Sound-Based Damage Detection".

FIELD OF THE INVENTION

The present invention is directed to devices and methods of detecting misfeeds and multifeeds in a document handling apparatus. In particular, to devices and methods utilizing ultrasonic transducers and sonic processing to detect jams and multifeeds.

BACKGROUND OF THE INVENTION

Document scanners feed and transport paper documents past one or more imaging subsystems in order to create digital image files representative of the originals. When two or more documents or pieces of paper have inadvertently been delivered to the imaging portion of the scanner by the feeding mechanism (referred to herein as a "multifeed") there is loss of information capture because of the overlap of the documents. This leads to the need to sort and rescan those documents and a loss of productivity. Most document scanners in the commercial arena utilize ultrasonic energy transmitted through the document to a receiver to detect when multifeeds occur. This technology is also employed in other paper transport devices when knowledge about whether more than one layer of paper is present is important, such as in ATM machines that dispense paper money. Most systems rely on a substantial drop in received amplitude of the ultrasonic energy due to destructive interference of the ultrasonic energy within the thin air gap or gaps between the multiple sheets of paper. Other systems use a combination of amplitude drops and the phase shift differential of multiple sheets vs. one sheet for detection of multifeed conditions as described in the U.S. patents listed above.

Additionally, systems have been described that detect excessive or unique sound energy using an audio frequency microphone, said energy created by the document being transported when the document or documents are being damaged, wrinkled, torn or otherwise deformed by the feeding and transport process (referred to herein as a "misfeed"). These sounds are differentiated from the normal sounds of the mechanisms via processing of the audio frequency sounds. The sounds are quantified, compared to a threshold (which may be adjustable), and then used to immediately stop the feeding and/or transport mechanism in order to prevent or substantially limit damage to the documents.

Incorporating both a receiving device or devices for the ultrasonic energy (typically in the range of 40 KHz. to 300 KHz.) and an additional device or devices for receiving audio information (typically in the range of 1 KHz. to 10 KHz.) represents both a cost penalty and a packaging challenge given the position of drive rollers and other sensors within the document transport design.

SUMMARY OF THE INVENTION

This invention combines both functions of ultrasonic-based multifeed detection and sound-based damage detection based on one receiving device (in the preferred method, an electret microphone), saving cost and enabling physical placement in paper transport systems where space may be at a premium. In addition, the electret microphone used here is substantially less expensive than dedicated ultrasonic receivers.

The electret microphone operates over a wide frequency range and is capable of simultaneously detecting the sound patterns associated with document damage along with the 40 KHz. tone for multifeed detection. After buffering the signal with an amplifier, the spectrum of sound energy is split via two bandpass filters into a low frequency channel for damage detection and a high frequency channel for multifeed detection. Each subsystem, damage detection and multifeed detection, act independently on the information presented by their respective bandpass filters. It is important to keep the low frequency sound filtered out of the ultrasonic waveform used for multifeed detection as this sound modulates the high frequency ultrasonic tone in both amplitude and phase, degrading detection performance. Similarly it is important to filter out the ultrasonic tone before it is passed to the damage detection subsystem due to frequency aliasing by the analog-to-digital sampling process. This aliasing results in beat frequencies that can fall into the range of frequencies considered by the damage detection algorithm.

Additionally, it has been found that mounting the sound detection device (microphone) in a compliant mount or rubber isolator helps to reduce the conduction of unwanted sounds, noise, and vibrations into the microphone from the scanner mechanisms.

The electrical output amplitude of the sound detecting device, typically a microphone, at the ultrasonic frequency of the preferred embodiment (40 KHz.) is much lower than that of the piezoelectric receiver described in the prior art. This requires additional amplification of the microphone output compared to the conventional ultrasonic receiver.

The ultrasonic-based multifeed detection determines when two or more documents overlap between the transmitter and receiver transducers. The output can be used to immediately stop the transport, or to allow the documents to be transported with a warning to the operator. There are several other options related to passing or not passing the document image to the host computer based on multifeed detection.

A preferred embodiment of the present invention comprises a sheet handling apparatus comprising a transport path and a device adapted to separate a first sheet from a plurality of stacked sheets and to feed the first sheet into the transport path. Detectors are positioned near the transport path to detect a multifeed condition indicating that a second sheet is overlapping the first sheet or a misfeed condition indicating that the first sheet is being damaged in the transport path. A processing system is coupled to the detectors and is adapted to receive and process signals from the detectors to determine either a multifeed or a misfeed in the transport path. If so, feeding sheets is terminated. The detectors comprise ultrasonic transducers and microphones. Two frequency bands are separately processed to make determinations of a misfeed or a multifeed or both.

Another preferred embodiment of the present invention comprises an article processing apparatus comprising a transport path for the articles and a feeder device for feeding individual ones of the articles into the transport path. Audio detectors are positioned in the transport path to detect either a multifeed condition or a misfeed condition in the transport path. A processing system is coupled to the detectors to receive and process signals therefrom. The processing system is configured to terminate processing in response to the signals from the detector. The detector preferably comprises an ultrasonic device and a microphone. An A/D converter converts the signals from the detectors into digital data frames. An energy level of the data frames is calculated to determine if the data frames indicate the misfeed condition.

Another preferred embodiment of the present invention comprises a document handling apparatus comprising a document transport path for moving the document therethrough. A detector proximate the transport detects a multifeed indication in the transport path or a misfeed indication in the transport path. A processing system processes the indications and issues a termination signal if a multifeed or a misfeed, or both, is determined. The detector preferably comprises a microphone, the multifeed indication comprises ultrasonic sound, and the misfeed indication comprises sound emanating from the document being damaged, such as wrinkling or tearing. The processing system also filters the multifeed indication and the misfeed indication into separate frequency bands for separate processing by the processing system. A converter is present for converting the misfeed indication into digital data frames. The processing system analyzes the digital data frames and determines whether the document is undergoing the misfeed.

It should be noted that in the present patent application preferred embodiments are described in terms of a scanner only for representative preferred embodiments. The present invention is not so limited, and the use of the term "scanner" is hereby intended to refer to any document or paper conveyance machine. These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

DETAILED DESCRIPTION OF THE INVENTION

Figure 1:
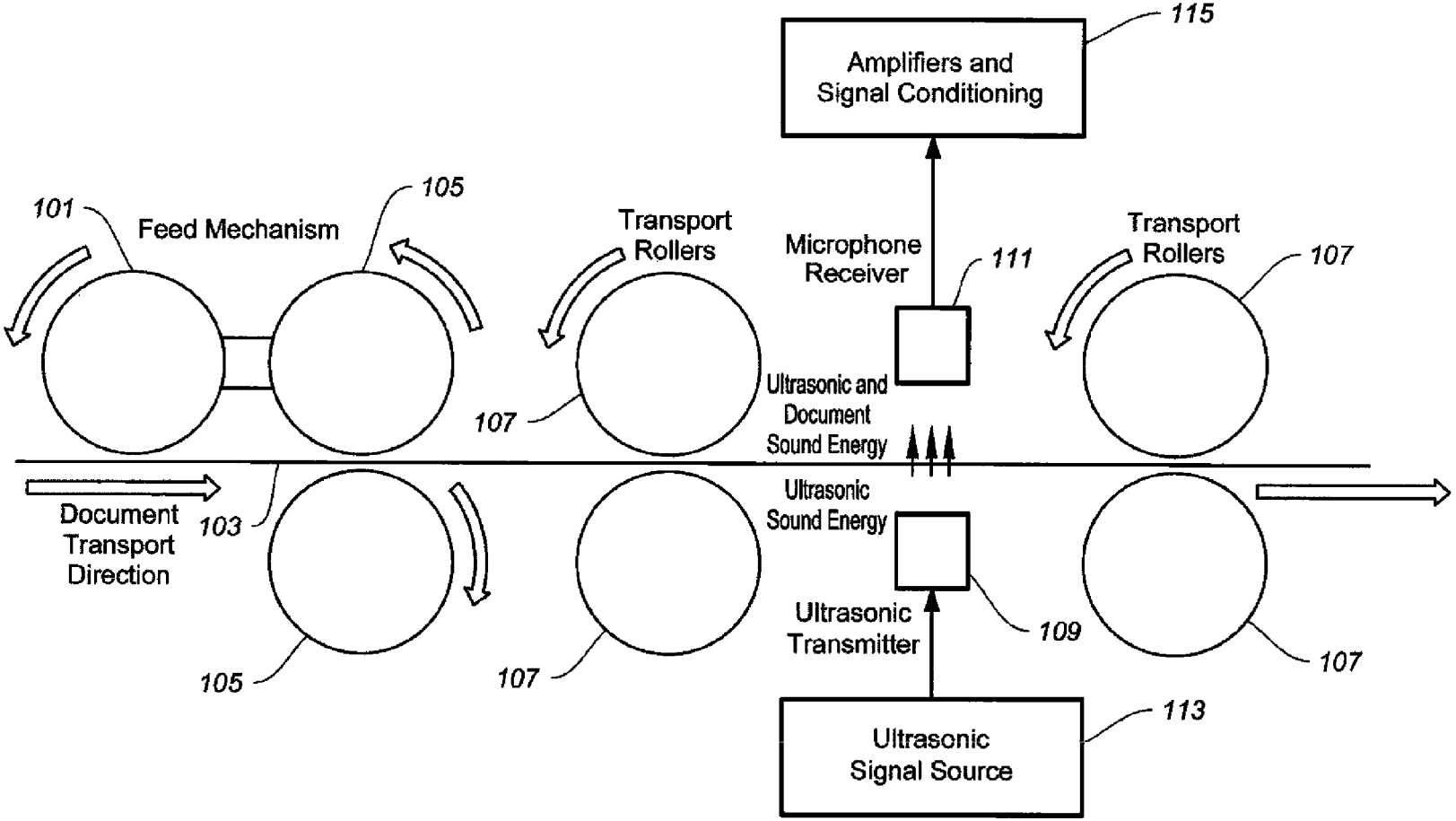
FIG. 1 illustrates a document feed and transport path.

With reference to FIG. 1, document 103 is moved forward by urging roller 101 into the feed and separation nip created by contact of rollers 105. Not shown is a standard input tray holding a stack of documents wherein the urging roller is configured to separate the first one of the documents from the stack. One document at a time is sequentially pushed further into the transport rollers 107 by selective rotation of the feed mechanism rollers 105. Ultimately the document is transported to an imaging station or stations to be converted into a digital image. Ultrasonic transmitter 109 is driven by signal generator 113 and emits sound energy which passes through document 103 to microphone receiver 111. In addition, sound energy created by the physical transport of the document through the transport is also converted to an electrical signal by receiver 111. This sound energy may be characteristic of normal, undamaged transport of the document including that of the scanner itself, or may contain sounds characteristic of a document undergoing damage as a result of the feed and/or transport process. The electrical signal from microphone 111 is representative of a composite of the ultrasonic energy used for multifeed detection as described by the prior art, and the lower frequency sounds associated with document transport. This composite signal is conveyed to amplifiers and signal conditioning block 115 which is described later.

Figure 2A:
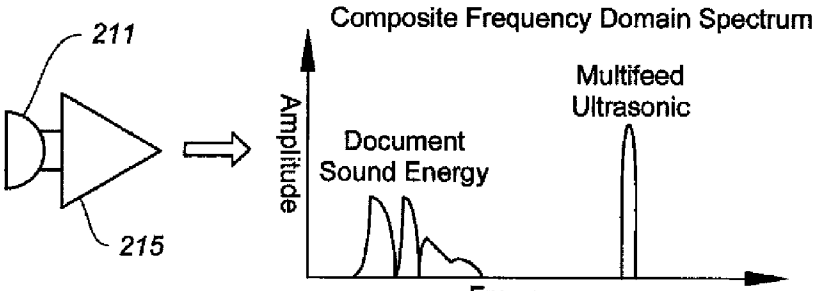
FIGS. 2A-E illustrate frequency domain band pass filtering.
Figure 2B:
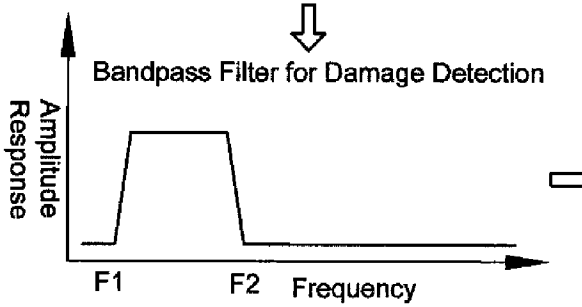
Figure 2C:
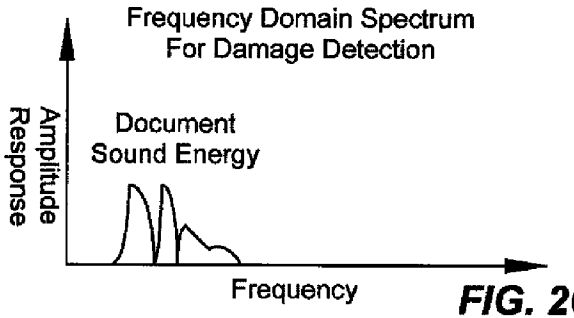
Figure 2D:
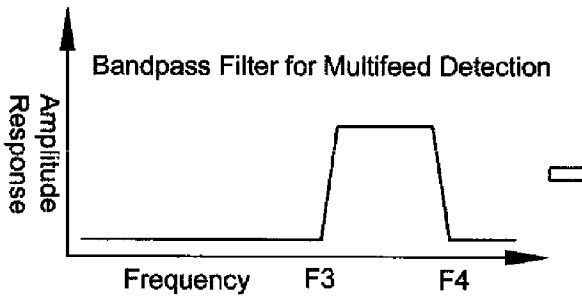
Figure 2E:
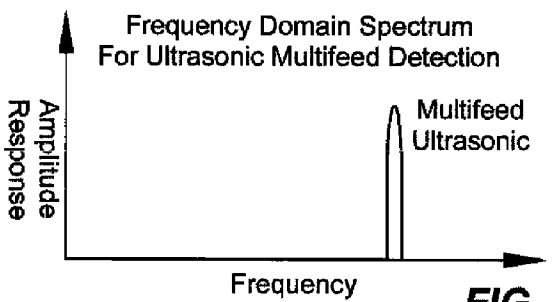

With reference to FIGS. 2A-E, the electrical signal from microphone 211 is representative of a composite of the ultrasonic energy used for multifeed detection as described by the prior art and the lower frequency sounds associated with document transport including, potentially, those associated with document damage. This composite signal is conveyed to amplifiers and signal conditioning block 215 and is illustrated in the frequency domain in FIG. 2A. The signal conditioning electronics separates the relatively low frequency signals associated with document transport, including the sounds of potential damage, using the bandpass filter in FIG. 2B that allows frequencies between the lower limit of F1 and the upper limit of F2 in the range of approximately 100 Hz to 10 KHz respectively to pass through while greatly attenuating the high frequency ultrasonic tone. The output of this filter is shown in FIG. 2C. Similarly the bandpass filter illustrated in FIG. 2D has lower and upper limits of F3 and F4 in the range of approximately 30 KHz to 50 KHz respectively designed to pass the high frequency ultrasonic signal while greatly attenuating the lower frequency signals which would result in unwanted corruption of the ultrasonic signal used for multifeed detection. The output of the bandpass filter illustrated by FIGS. 2B and 2C is passed to an analog-to-digital converter, which receives analog audio data and converts these to digital data frames as described below, and further processing for damage detection while the output of the bandpass filter illustrated by FIGS. 2D and 2E is passed to processing for multifeed detection as described by the prior art.

Figure 3:
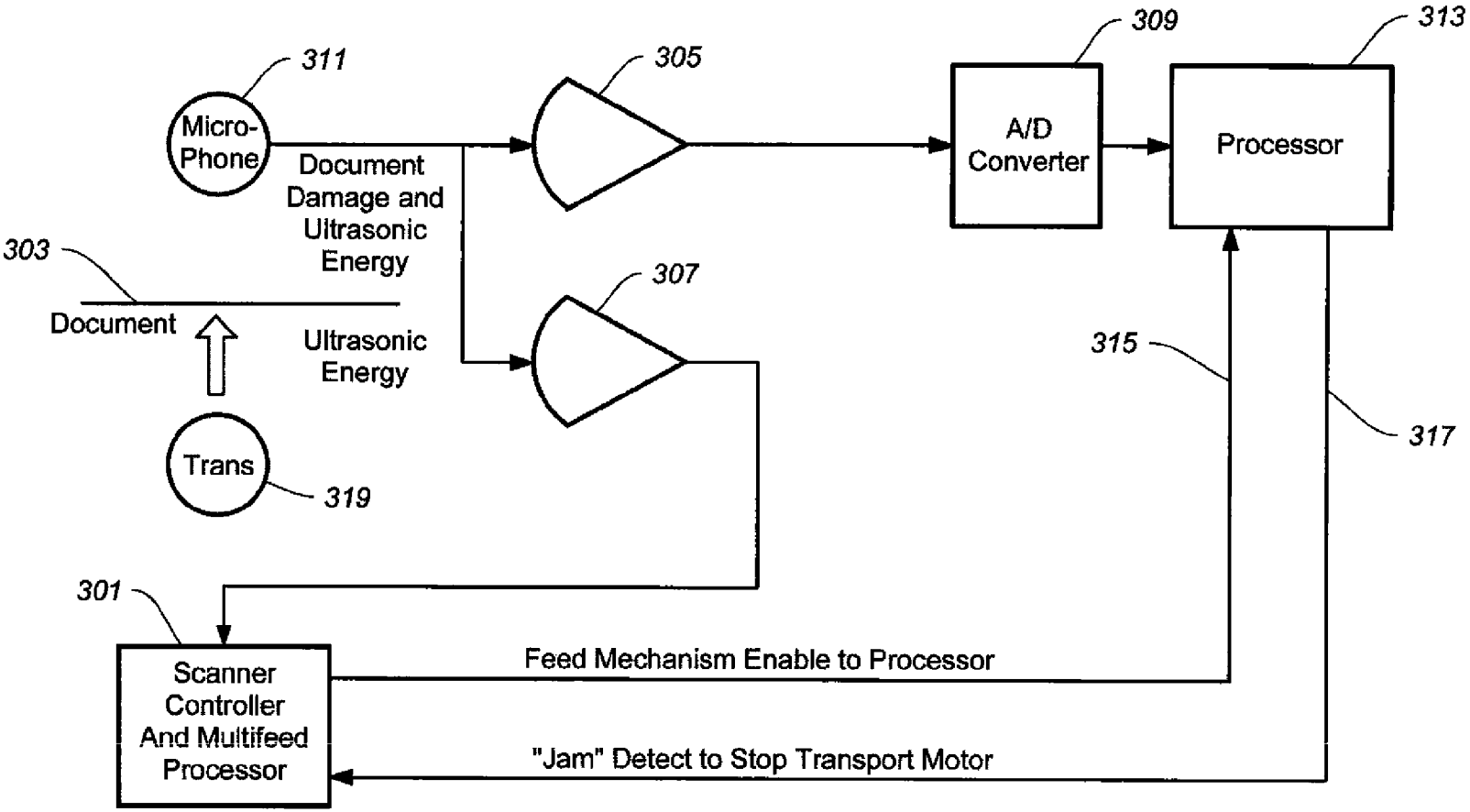
FIG. 3 illustrates a sonic processing circuit.

With reference to FIG. 3, the output of microphone 311 is amplified and filtered in the frequency domain by a split path. The output of amplifier and filter block 307 contains signals associated with ultrasonic-based multifeed detection and is passed to the scanner controller 301 for processing as described by the prior art. This processing can include continuing sheet feeding if the detected multifeed is acceptable, for example, a sticky-note intentionally attached to a document, and includes terminating sheet feeding if the multifeed is due to error. The output of amplifier and filter block 305 contains signals primarily associated with document transport, including those associated with possible damage as it is transported. These signals are converted to a digital representation by analog-to-digital converter 309 and then to the document damage processor 313 which makes a determination if the sound signals represent those of a document being damaged or not. Processor 313 receives signal 315 from the scanner controller when the feed mechanism is engaged. This prepares the damage detection processor 313 and initiates the detection algorithm which will be described later. If sounds associated with document damage are detected with sufficient energy and within timing windows as described below, then an output 317 from processor 313 is sent to the scanner controller which in turn quickly stops the transport and feed mechanisms to limit the damage to the document in question.

Damage Detection Algorithm

The damage detection processor determines when document damage due to misfeeding, wrinkles, staples, adhesion or other factors is occurring and stops the document transport motors and feed mechanisms in a very brief time interval to prevent further damage to the documents. The document damage detection algorithm uses the idea of differentiating between the sound made by a normal document entering a document scanner and the sound of a document being wrinkled due to a jam. For a system to make this distinction, it is important to ignore or in some way isolate the background sounds of the scanner from the sounds coming from the document. The background sounds come from various moving parts of the scanner. The moving parts include, but are not limited to, the transport motors, transport rollers, feeder mechanism and possible cooling fans. These scanner background sounds are typically periodic and have low frequency components relative to that of documents being damaged.

Figure 4:
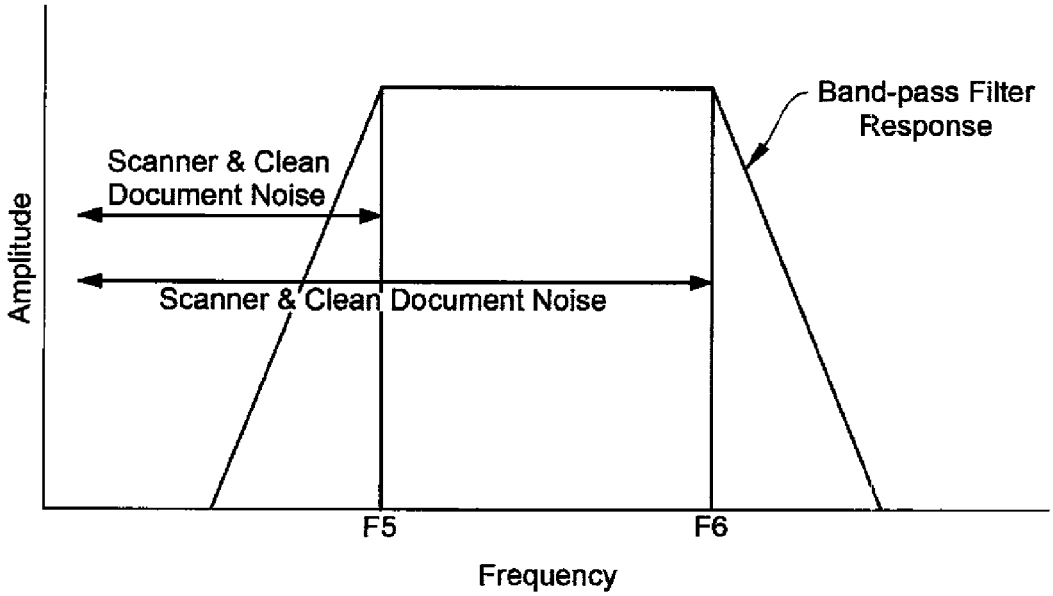
FIG. 4 illustrates a pertinent frequency domain for detecting document damage.

On the other hand, the sounds from a wrinkling or damaging document are a short duration signal in the time domain and have frequency components spread over a wide range in the frequency domain. In addition, the sound of a clean document being scanned typically has frequencies that overlap the frequencies that of a wrinkling document. Therefore, the algorithm can detect a jamming document by computing the energy of the audio signal by looking at a frequency band between F5 and F6 as shown in FIG. 4, where F5 is the upper frequency limit of the background noise/clean document in the range of approximately 1 KHz. and where F6 is the upper frequency of a jamming document in the range of approximately 4 KHz. This bandpass filter is in addition to the filter previously described that performs the first level of separation in the frequency domain between the damage detection sounds and the multifeed ultrasonic signal. The cut-off frequency F5 is selected such that all the background sounds from different moving parts of the scanner and the sound associated with a clean document are substantially or detectably below this cut-off as shown below. This cut-off frequency selection can be based on test data collected and recorded from the scanners during normal operation.

Figure 5:
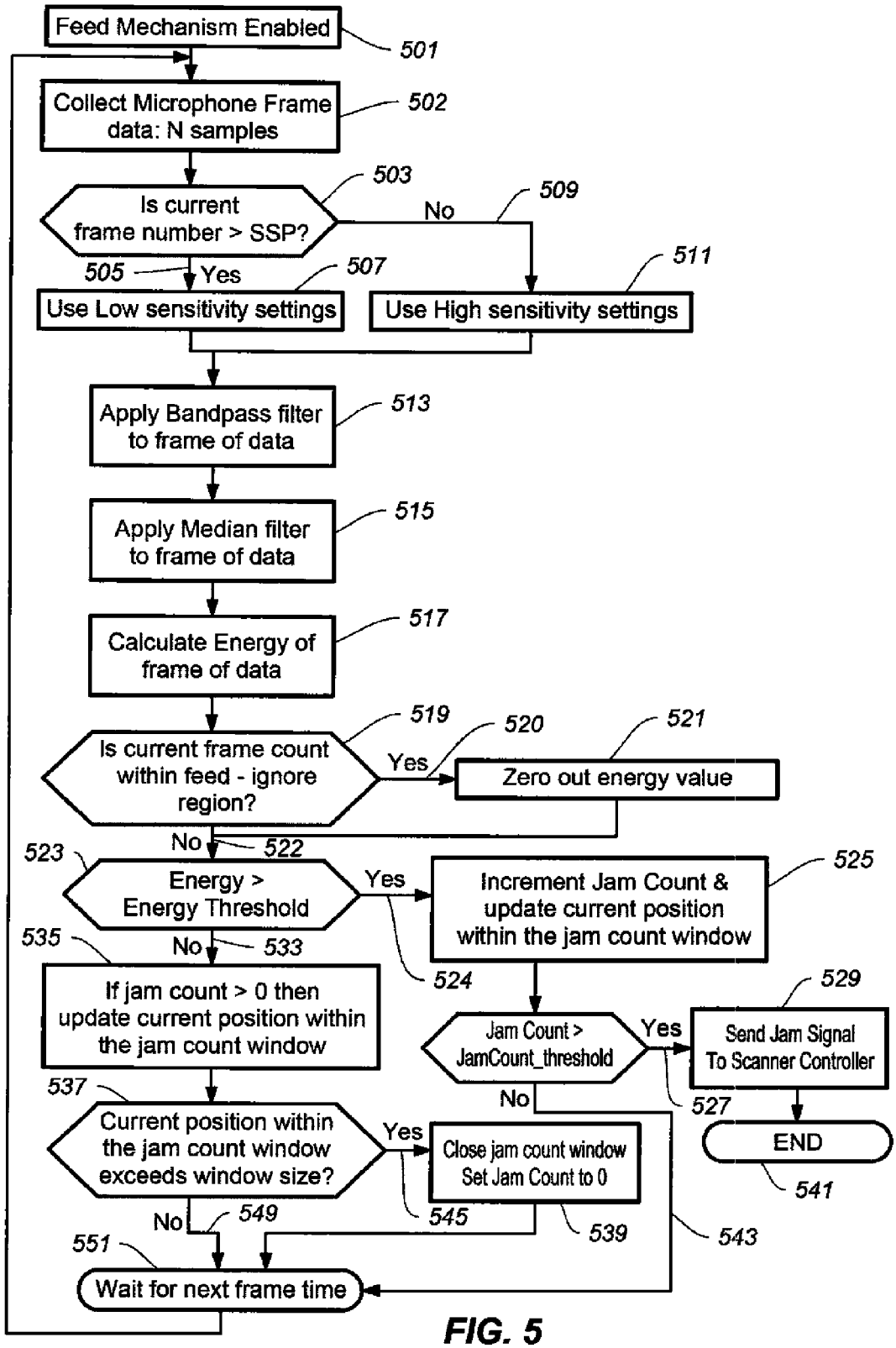
FIG. 5 illustrates a flowchart of an algorithm for implementing the present invention.

With reference to FIG. 5, when the feeder mechanism is enabled 501, a document starts to enter the transport of the scanner. The damage detection processor uses a communicated feed enable signal generated at this point to determine when to start sampling the microphone. The algorithm for jam detection uses a frame-based processing technique. The system collects the digitized microphone data and processes the data in fixed data sets or frames that consist of N samples per frame 502, for example, typically approximately 50 samples. The algorithm receives multiple frames of microphone data and then will determine if the data is indicative of a document jam as will be described below. These frames of data are non-overlapping and each frame consists of approximately a one millisecond duration of audio data.

As the trail-edge of the document enters the document transport and passes over the point of feeding at the contact nip between rollers 105, the trail edge of the document may make a snapping sound that creates a sharp impulse in the audio signal. To reduce the probability of false jam detection on the trail-edge, an additional check 503 needs to be performed to determine where the microphone frame was captured in relation to the lead-edge of the document. This is done by keeping track of how many frames have been processed since the feeder mechanism enable signal was asserted, and if the current frame number has passed the Sensitivity Switch Point (SSP). The Sensitivity Switch Point is dictated by the length of the shortest document that can be safely transported. The trail edge will pass by the point of feeding sooner for short documents and is therefore the limiting case for the need to switch to a lower sensitivity and avoid false jam detections. The number of frames counted to cross the SSP is equivalent to the time to transport the shortest document such that the trail edge passes over the point of feeding.

If the frame count is greater than the Sensitivity Switch Point 505, then the current frame for the microphone is susceptible to this trailing edge false detection and the low sensitivity settings are used 507 in a later stage for determining whether or not a document jam has occurred. If the frame count has not passed the SSP 509, then the high sensitivity settings will be used 511.

Each frame of microphone output data is next processed by sending the digitized data through a band pass filter 513 with lower and upper cutoff frequencies F5 and F6 as previously described in FIG. 4.

A 1D median filter 515 is next applied to the frame of data to help distinguish audio characteristics between a document that is merely wrinkled which exhibits intermittent high peak values, as opposed to a document in the process of being damaged which has relatively continuous high values of amplitude. The median filter, energy threshold calculations, and Jam Count window accumulation all combine to distinguish merely wrinkled documents from those being damaged during transport.

After the median filter, the energy of the microphone frame of data is calculated 517. The energy of the frame of data is calculated with the equation below, where N represents the number of data samples within a frame, and $mic_{data}$ is a number correlated to a sound intensity of each individual digitized audio sample.

$$\left(\sum_{1}^{N}(mic_{data})^2\right)$$

If the microphone frames are captured immediately after the feeder mechanism is enabled 520 then the algorithm completely ignores these frames of data by forcing the energy level to zero 521. An example number of ignored frames is about thirty. This prevents the algorithm from falsely detecting the feeder mechanism noise as a potential jam. Otherwise 522 the energy calculation from 517 is compared against a sensitivity threshold 523 that is varied depending on whether we are in the low or high sensitivity mode as determined previously in 503. A potential wrinkling document is detected when the energy level of the frame goes above the Energy_Threshold 524. When this occurs, the algorithm initiates a jam count window if one has not been previously initiated and increments the Jam Count variable 525. This window defines a block of frames where the energy level of some minimum number of frames must exceed the Energy_Threshold before an actual jam detection signal is issued. If the Jam Count exceeds the JamCount_Threshold 527, then the jam signal is asserted 529 and the algorithm terminates 541. Otherwise, if the Jam Count is below the JamCount_Threshold 543, then the algorithm waits for next frame of data.

If the energy level of this particular data frame is below the Energy_Threshold 533 then the algorithm increments the current position within the jam count window, assuming a jam had occurred on an earlier frame (jam count>0) and a jam count window was open 535.

If a jam count window was opened by a previous frame exceeding the energy threshold, and the current frame position count reaches the end of the fixed window size 537 before the Jam Count exceeds the JamCount_Threshold, then the window is closed and the Jam Count is reset to zero 539 and the algorithm waits for the next frame of data 551. Otherwise 549 the algorithm waits for the next frame of data 551.

Figure 7:
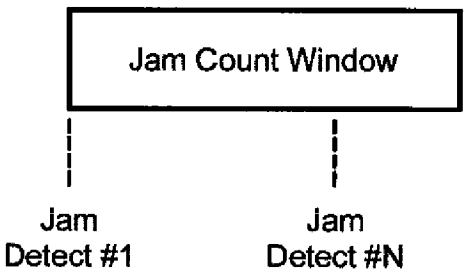
FIG. 7 represents the first frame where the energy level exceeds the Energy_Threshold.

In FIG. 7, "Jam #1" represents the first frame where the energy level exceeds the Energy_Threshold and the jam count window opens. As each future frame is processed, the current position within the window is updated. Jam Detect #N represents the frame where the Jam Count exceeds the JamCount_Threshold before the window closes.

Figure 6:
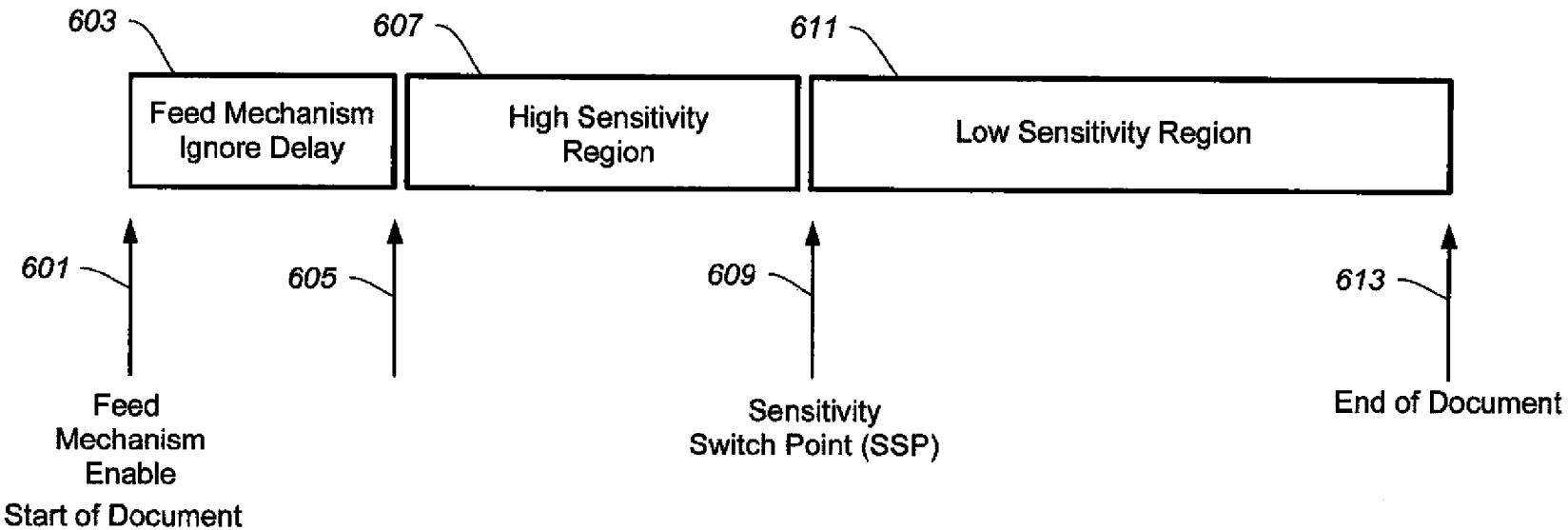
FIG. 6 illustrates a timing diagram for processing document misfeeds.

With reference to FIG. 6, this timing diagram represents a single document traveling through the scanner. The damage detection algorithm commences when the feed mechanism enable signal is passed 601 from the main scanner controller to the damage detection processor. The delay period 603 is utilized to avoid false jam detection due to the sounds associated with the feed mechanism and a document entering the paper transport. At the end of this delay 605 the algorithm starts to actively look for sound signal data associated with document damage. The initial portion of the document is processed at high sensitivity in region 607 until there is the risk of false damage detection due to the trail edge of the document. At this point 609 the sensitivity drops to the lower sensitivity for the remainder of this document 611 until the end of the document is reached 613 and the algorithm terminates until the next document is fed.

The invention has been described in detail with particular reference to certain preferred embodiments thereof, but it will be understood that variations and modifications can be effected within the spirit and scope of the invention.

Parts List

101 Roller
103 Document
105 Rollers
107 Rollers
109 Transmitter
111 Microphone
113 Signal Source
115 Signal Conditioner
211 Electric Circuit
215 Electric Circuit
301 Controller
303 Document
305 Electric Circuit
307 Electric Circuit
309 Converter
311 Microphone
313 Processor
315 Signal
317 Signal
319 Transmitter
501 Step
502 Step
503 Step
505 Branch
507 Step
509 Branch
511 Step
513 Step
515 Step
517 Step
519 Step
520 Branch
521 Step
522 Branch
523 Step
524 Branch
525 Step
527 Branch
529 Step
533 Branch
535 Step
537 Step
539 Step
541 End
543 Branch
545 Branch
549 Branch
551 Step
601 Pointer
603 Document
605 Pointer
607 Document
609 Pointer
611 Document
613 Document

The invention claimed is:

1. A sheet handling apparatus comprising:

a transport path;

a device adapted to separate a first sheet from a plurality of stacked sheets and to feed the first sheet into the transport path;

only one detector positioned near the transport path to detect a signal indicative of a multifeed condition indicating that a second sheet is overlapping the first sheet and a signal indicative of a misfeed condition indicating that the first sheet is being damaged in the transport path; and a processing system coupled to the detector, adapted to receive and process signals from the detector and to filter the audio signals into separate first and second frequency bands for separate processing, wherein the first frequency band is used to determine the multifeed condition and the second frequency band is used to determine the misfeed condition, the processing system configured to determine either a multifeed in the transport path or a misfeed in the transport path and to terminate feeding sheets in response to the determination.

2. The apparatus according to claim 1, wherein the detector comprises an ultrasonic energy source.

3. The apparatus according to claim 2, wherein the detector further comprises a microphone.

4. The apparatus according to claim 3, wherein the detector further comprises a mount made from a compliant noise isolating material.

5. The apparatus of claim 1, further comprising a filter for separating the signals into two frequency bands.

6. The apparatus of claim 1, wherein the processor is further configured to calculate an energy level of the digital audio data in the second frequency band to determine the misfeed.

7. The apparatus of claim 1, wherein the processing system further comprises a converter for converting the signals from the detector into the digital data.

8. An article processing apparatus for processing a plurality of articles, comprising:

a transport path for the plurality of articles;

a feeder device for feeding individual ones of the articles into the transport path;

only one audio detector positioned in the transport path to detect signals indicative of a multifeed condition in the transport path and a misfeed condition in the transport path; and a processing system coupled to the detector to receive and process signals from the detector and to filter the signals into separate first and second frequency bands for separate processing, wherein the first frequency band is used to determine the multifeed condition and the second frequency band is used to determine the misfeed condition, the processing system configured to terminate processing the plurality of articles in response to the signals from the detector.

9. The apparatus according to claim 8, wherein the detector comprises an ultrasonic device and a microphone.

10. The apparatus according to claim 8, further comprising a converter coupled to the detector for converting the signals from the detector into digital data frames which are received by the processing system.

11. The apparatus of claim 10, wherein the processing system for calculates an energy level of the data frames to determine if the data frames indicate the misfeed condition.

12. The apparatus according to claim 11, wherein the processing system counts a number of data frames that indicate the misfeed condition.

13. The apparatus of claim 12, wherein the processing system issues a termination signal in response to the number of data frames that indicate the misfeed condition exceeding a preselected number.

14. A document handling apparatus comprising:

a document transport path for moving the document therethrough;

only one detector proximate the transport path for detecting a signal indicating a multifeed in the transport path and for detecting a signal indicating a misfeed in the transport path; and a processing system coupled to the detector for processing the signal indicating multifeed and the signal indicating misfeed, for filtering the signal indicating multifeed and the signal indicating misfeed into separate frequency bands for separate processing, and for issuing a termination signal terminating document handling by the apparatus in response to determining a multifeed or a misfeed or both.

15. The apparatus according to claim 14, wherein the detector comprises a microphone, the signal indicating multifeed comprises ultrasonic sound, and the signal indicating misfeed comprises sound emanating from the document being damaged.

16. The apparatus according to claim 15, wherein the processing system includes a converter coupled to the detector for converting the signal indicating misfeed into digital data frames.

17. The apparatus according to claim 16, wherein the processing system comprises a processor for analyzing the digital data frames and determining whether the document is undergoing the misfeed.

* * * * *